United States Patent [19]

Drews et al.

[11] 4,084,552

[45] Apr. 18, 1978

[54] METHOD AND APPARATUS FOR FUEL INJECTION CONTROL

[75] Inventors: Ulrich Drews, Vaihingen-Pulverdingen; Peter Werner, Stuttgart; Lothar Winkelmann, Ludwigsburg, all of Germany

[73] Assignee: Robert Bosch GmbH, Stuttgart, Germany

[21] Appl. No.: 702,929

[22] Filed: Jul. 6, 1976

[30] Foreign Application Priority Data

Jul. 8, 1975 Germany ..... 2530308

[51] Int. Cl.[2] ..... F02B 3/00

[52] U.S. Cl. ..... 123/32 EA; 123/32 ED

[58] Field of Search ..... 123/32 EA, 32 ED, 32 EI, 123/32 EH, 32 EG, 117 R

[56] References Cited

U.S. PATENT DOCUMENTS

| | | | |
|---|---|---|---|
| 2,842,108 | 7/1958 | Sanders | 123/32 EA |
| 3,662,720 | 5/1972 | Boeters et al. | 123/32 EA |
| 3,749,065 | 7/1973 | Rothfusz et al. | 123/32 EH |
| 3,785,353 | 1/1974 | Borisou et al. | 123/32 EA |
| 3,854,458 | 12/1974 | Reddy | 123/32 EA |
| 3,863,054 | 1/1975 | Monpetit | 123/32 EA |

FOREIGN PATENT DOCUMENTS

| | | | |
|---|---|---|---|
| 1,962,573 | 6/1971 | Germany | 123/32 EA |

*Primary Examiner*—Charles J. Myhre
*Assistant Examiner*—Parshotam S. Lall
*Attorney, Agent, or Firm*—Edwin E. Greigg

[57] ABSTRACT

A control pulse generator for the fuel injection system of internal combustion engines. The rpm-dependent trigger signal is applied simultaneously to two multivibrators one of which generates pulses whose length is determined by engine parameters while the other generates pulses of fixed length. A logical circuit selects the longer of these pulses so that the fuel control pulse will always have at least a minimum length.

10 Claims, 4 Drawing Figures

METHOD AND APPARATUS FOR FUEL INJECTION CONTROL

BACKGROUND OF THE INVENTION

The invention relates to a method and an apparatus for the control of fuel injection signals to be used with the fuel injection system of an internal combustion engine. The intermittent injection control signals have a minimum duration and the fuel injection system includes a first pulse generator circuit which generates preliminary pulses proportional to the aspirated air quantity and rpm. The system includes a multiplying circuit connected in series with the pulse generator circuit and both of these circuits contain capacitors which control multivibrators.

It is known to provide an electronic fuel injection system in which the duration of the control pulses for the various fuel injection valves is determined substantially from the load of the engine at any given time and the instantaneous rpm. A circuit, which will be explained in more detail below, uses these two variables to provide a so-called preliminary pulse. However, when the variables which define the duration of these pulses, i.e., the rpm and the load, assume unfavorable values, for example, if the rpm is very high and the load very small, for example during downhill operation, the duration of the control pulses can be so short that it results in a critical fuel metering in which the fuel mixture no longer is able to sustain combustion in the cylinder. Such a condition is very undesirable in internal combustion engines that employ exhaust gas purifiers, for example catalyzers or after-burners, because the uncombusted fuel can cause substantial damage to these devices.

OBJECT AND SUMMARY OF THE INVENTION

It is a principal object of the present invention to improve a fuel injection system of the general type described above in such a way that the system generates pulses whose width cannot fall below a certain predetermined value so that a fuel mixture may be provided to the engine which is always combustible. The invention further provides that the minimum pulse width is made subject to certain other system parameters. This provision prevents the possibility of providing an excessively rich mixture which could happen in certain engines if the minimum duration were fixed at all times.

Accordingly, the present invention provides a method and an apparatus in which the minimum control pulse durations are adapted to the particular engine.

These objects are attained by the invention by providing within the control system a monostable multivibrator whose time constant is independent of the engine load conditions and which is triggered at a frequency that depends on the engine rpm. The output signals from this monostable multivibrator, as well as the output pulses from the first pulse generator circuit, are fed to a logical junction circuit which chooses those pulses which have the longer pulse width, and the output signals from the junction circuit are fed to the second, i.e., the multiplier circuit in the fuel injection system.

The multiplying circuit is preferably of the pulse-width modulating type, in which the width of an output pulse is changed in proportion to an input signal. A suitable circuit of this type is described, for example, in U.S. Pat. No. 3,734,067.

Since the time constant of a monostable multivibrator may be set very precisely and since such a circuit has a time constant defined by the discharge time of a capacitor and is thus not subject to disturbances, the preliminary injection pulses may be provided with a precisely defined minimum length; they are then fed to the multiplying circuit of the fuel injection system. The load-independent and, at first, rpm-independent pulses provided by the monostable multivibrator are associated with the preliminary pulses $t_p$ and take their place when the preliminary pulses $t_p$ are shortened to a degree that would be impermissible, so that the minimum pulse length $t_{p\,min}$ must instead be used.

A favorable embodiment of the invention provides that the minimum control pulse from the monostable multivibrator circuit may also be made rpm-dependent.

The invention will be better understood as well as further objects and advantages thereof become more apparent from the ensuing detailed description of two exemplary embodiments taken in conjunction with the drawing.

DESCRIPTION OF THE PREFERRED EMBODIMENTS

Figure 1:
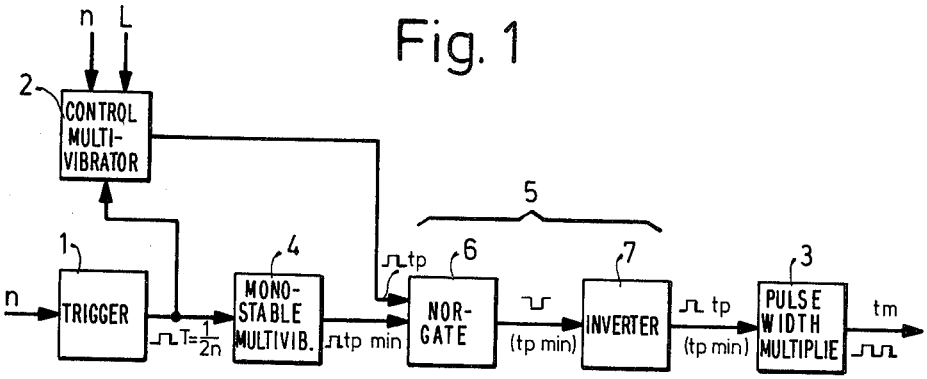
FIG. 1 is a block circuit diagram of the apparatus according to the present invention.

Turning now to FIG. 1, there is illustrated in simplified manner the principal construction of a fuel injection system according to the invention. The system includes a trigger circuit 1 to which is fed an rpm-dependent signal and from which there is obtained a trigger pulse train whose frequency is proportional to the rpm and whose keying ratio is 1:1, i.e. a symmetric pulse. This pulse train is also illustrated as the topmost curve in diagrams A and B of FIG. 4, for two different engine speeds. The pulse duration T of this pulse train is equal to $1/2n$ and thus is associated with a particular type of internal combustion engine, namely a four-cylinder engine having a particular type of injection. It is to be understood that other rpm-proportional trigger pulse trains can be used. The triggering pulses are fed firstly to a pulse generator circuit 2 which will henceforth be referred to as a control multivibrator circuit. A suitable control multivibrator circuit is described, for example, in U.S. Pat. No. 3,734,067. The control multivibrator circuit receives information regarding the instantaneous engine rpm as well as the aspirated air flow rate and, triggered by the triggering circuit, delivers output pulses $t_p$ whose duration determines the length of the final injection control pulses. For this purpose, the control multivibrator includes a monostable multivibrator whose timing capacitor is located in a feedback branch. The time constant of the monostable multivibrator is defined by the charge exchange time of the capacitor which, in turn, is determined by a discharge current source and a charging current source. The discharge current is used as a measure for the air quantity provided to the engine and the normally constant charging current is turned on for a period of time inversely proportional to the engine rpm prior to the discharging process, so that the amount of charge stored in the capacitor is a measure of the engine rpm. In the normal case, the output pulses $t_p$ directly reach the second circuit 3 in the fuel injection system which will henceforth be called a multiplying circuit 3. This circuit has the job to at least double the duration of the pulses $t_p$ and also to offer opportunities for adapting the pulses to particular operational engine conditions.

Normally, these corrections are made in the multivibrator circuit and may affect the pulse duration substantially. In the present case however, the otherwise known fuel injection system is so engaged that when certain critical operational conditions occur, the effect of the preliminary pulse train $t_p$ is cancelled and it is replaced by a pulse train $t_{p\ min}$ coming from a circuit according to the invention. For this purpose, as shown in FIG. 1, there is provided a monostable multivibrator 4, also controlled by the triggering circuit 1, which generates pulses of duration $t_{p\ min}$ which are delivered in synchronism with the pulses $t_p$ to a subsequent junction circuit 5 which may be an OR gate and may consist of a single NOR gate 6 and a subsequent simple inverter 7.

Figure 2:
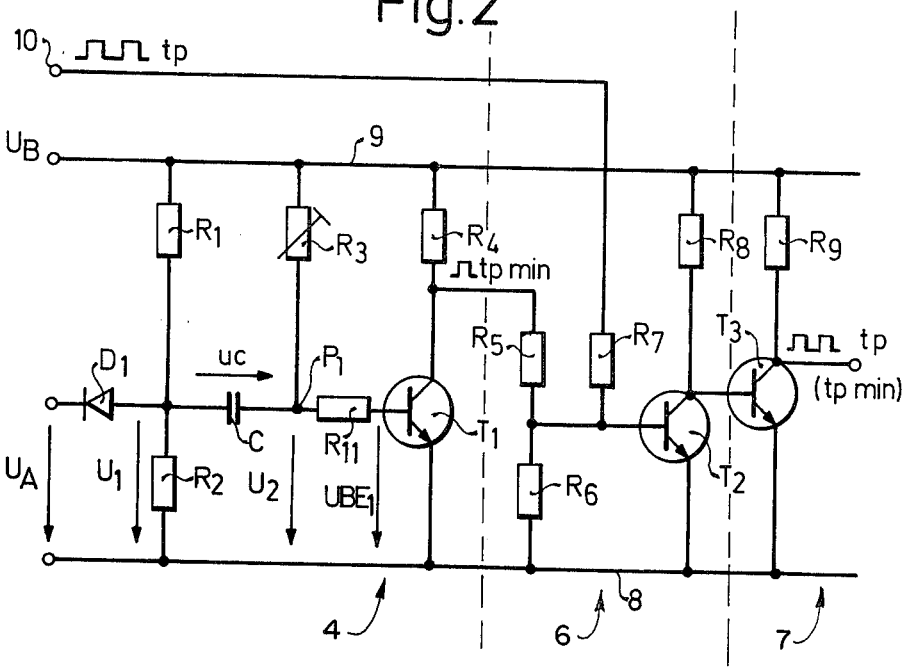
FIG. 2 is a detailed schematic circuit diagram of a first exemplary embodiment of the invention.

The first exemplary embodiment of the invention is illustrated in detail in FIG. 2 in which the blocks 1, 2 and 3 are no longer shown. The monostable multivibrator 4 illustrated in FIG. 2 is a so-called economy circuit including a transistor T1, resistors R1, R2, R3, R4 and R11, a capacitor C and a diode D1. The emitter of the transistor T1 is connected to the negative terminal 8 and its collector is connected via the resistor R4 to the positive terminal 9. It will be understood that the polarity designations are selected to aid the understanding but may be reversed in a circuit using semiconductors of different type.

The base of the transistor T1 is connected through the resistor R11 to a junction point P1 which is connected through a potentiometer R3 with the positive supply line. The junction point P1 is connected via the capacitor C to the junction of the two resistors R1 and R2 which form a voltage divider between the positive line 9 and the negative line 8. The transistor T1 is controlled through a diode D1 whose anode is coupled to the capacitor C.

The manner of operation of the above-described circuit will be explained after a brief description of the remainder of the circuit. The pulse $t_{p\ min}$ generated at the collector of transistor T1 travels through the voltage divider circuit made up of resistors R5 and R6 to the base of a subsequent transistor T2 whose emitter is connected to the minus line and whose collector is connected through a resistor R8 to the positive line. The base of the transistor T2 also receives the output pulses $t_p$ of the control multivibrator circuit which come from the input contact 10 through a resistor R7. Connected behind the transistor T2 is a further transistor T3 which serves as the inverter 7 and its base is directly connected to the collector of transistor T2 while its emitter is connected to the minus line 8, and its collector is connected through a resistor R9 to the positive line 9. The collector of the transistor T3 also acts as the output of the circuit which carries either the normal preliminary pulse $t_p$ generated by the control multivibrator circuit 2, or else carries the pulse train of the minimum width $t_{p\ min}$, generated by the monostable multivibrator 4, and the duration of the latter is determined by the particular adjustment of elements of the circuit, whereas a certain amount of rpm-dependency may also be included, as will be explained below.

The manner of operation of the circuit in FIG. 2 is as follows: The triggering voltage $U_A$ obtained from the trigger circuit 1 reaches the cathode of the diode D1 and it has the pulse duration $T = (1/2n)$, where $n$ is the engine rpm, while T is the time between ignition pulses. When the triggering voltage $U_A$ is positive, the diode D1 is blocked and the capacitor is capable of being charged to its maximum voltage $U_{c\ max}$.

The base of the transistor T1 is provided with positive voltage via the adjustable resistor R3, so that it conducts while there is a pulse present in the triggering voltage $U_A$ and its collector potential is thus essentially at ground. It should be noted at this time that the output pulse $t_p$ from the control multivibrator circuit 2 is triggered by the negative flank of the triggering voltage $U_A$ and the same is true for the present circuit. As soon as the negative voltage pulse arrives at the diode D1, the latter becomes conducting and the voltage at the base of the transistor T1 is pulled below the base-emitter voltage drop so that the transistor T1 blocks. It is also assumed that the voltage divider circuit comprising resistors R1 and R2 has a sufficiently low resistance so that, in the present exemplary embodiment of FIG. 2, the capacitor C is able to charge fully to the prevailing voltage during the positive pulse of the trigger potential $U_A$. During the negative pulse portion of the trigger voltage or during the time when the triggering voltage is substantially at ground potential, the capacitor C discharges through the adjustable resistor R3 and this discharging process continues until the voltage at the base of the transistor T1 is again equal to the base emitter voltage drop and the transistor T1 conducts.

The time during which the transistor T1 is blocked can be varied by adjusting the time constant $\tau = R_3 \cdot C$ and this is preferably done by adjusting the trimmer resistor R3. This time constant and the degree of charging of the capacitor is associated with the desired pulse duration $t_{p\ min}$ which appears at the collector of the transistor T1 as the output voltage.

Figure 4:
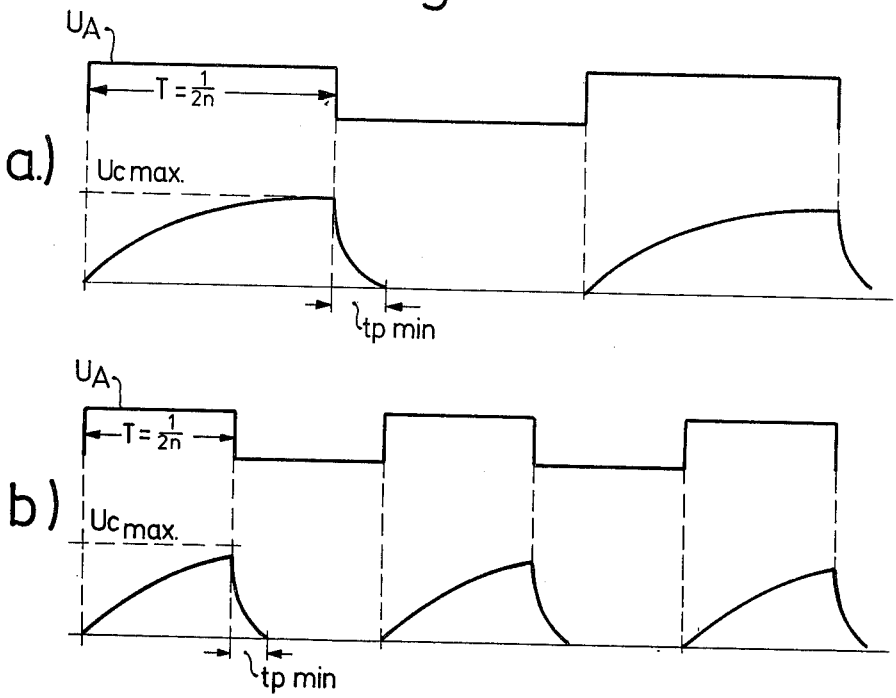
FIG. 4 is a set of curves showing the voltage which controls the monostable multivibrator as well as the voltage on the associated capacitor at two different rpms.

These events may be seen more clearly in the representation of FIG. 4, diagram *a*. In the diagram *a*, the rpm is so low that the pulse duration T is large enough for the voltage on the capacitor to rise substantially to its maximum value $U_{c\ max}$ provided that the resistors R1 and R2, which determine the charging time, are sufficiently low-valued. The output pulse $t_{p\ min}$ from the transistor T1 travels via the voltage divider circuit R5, R6 to the base of the subsequent transistor T2 which acts as a NOR gate (NOT OR gate); the base also receives the preliminary pulse train $t_p$ via the resistor R7. As may be seen, this transistor T2 remains conducting as long as its base receives one or the other of the pulses $t_{p\ min}$ or $t_p$. Thus these two pulse trains $t_p$ and $t_{p\ min}$ are joined in a manner that the pulse of longer duration is effective and is fed to the inverter formed by the transistor T3, which acts merely to provide the correct output polarity. As already mentioned, because the economy multivibrator 4 and the control multivibrator circuit 2 are triggered simultaneously, the two pulse trains $t_p$ and $t_{p\ min}$ also occur simultaneously, the transistor T2 becomes conducting and the transistor T3 blocks. During this time, the subsequent pulse width multiplier circuit 3 is triggered and will be assumed to remain active until such time as the longer lasting of the two pulses has expired. As the time constant corresponding to the duration of the pulse $t_{p\,min}$ is fixed, the minimum duration of the resulting injection control pulses is independent of both rpm and load. The value of the resistor R11 is chosen to be substantially smaller than that of the resistor R3 and its purpose is to isolate the transistor T1 from being affected by any fluctuations in the supply voltage. If this resistor were absent, the fluctuations at the supply voltage would act via the voltage divider R1, R2 and the capacitor C and directly affect the base of the transistor T1 which would then be blocked for short periods of time even for very slight voltage fluctuations. The presence of the resistor R11 insures that any voltage fluctuations must exceed a certain minimum value defined by the resistors R1, R2, R3 and R11 before they can affect the operation of the transistor T1. There are, however, occasions, as already mentioned above, when it is useful to make the time $t_{p\,min}$ dependent on the rpm up to a certain degree so as to be able to adjust the operation of the system to certain external characteristics of the engine.

It has already been mentioned that an rpm-dependent operation may be obtained if the resistance of the voltage divider R1 and R2 is increased, because this leads to an increase of the charging time constant which is defined by $\tau_1 = (R1.\ R2/R1 + R2).\ C$. In that case, the end of the capacitor charging process is determined by the end of the positive control pulse so that it takes place before the maximum capacitor voltage $U_{c\ max}$ is reached. These conditions are illustrated in FIG. 4*b* where it is seen that the pulse duration $t_{p\ min}$ can be made rpm-dependent.

Since the entire capacitor voltage $U_{c\ max}$ is not reached, the negative voltage jump at the base of the transistor T1 is then numerically smaller than before and the time during the discharge of the capacitor when the voltage drops to a point when the transistor T1 again becomes conducting, occurs sooner. Thus, the pulse duration $t_{p\,min}$ is smaller when the rpm is higher.

Figure 3:
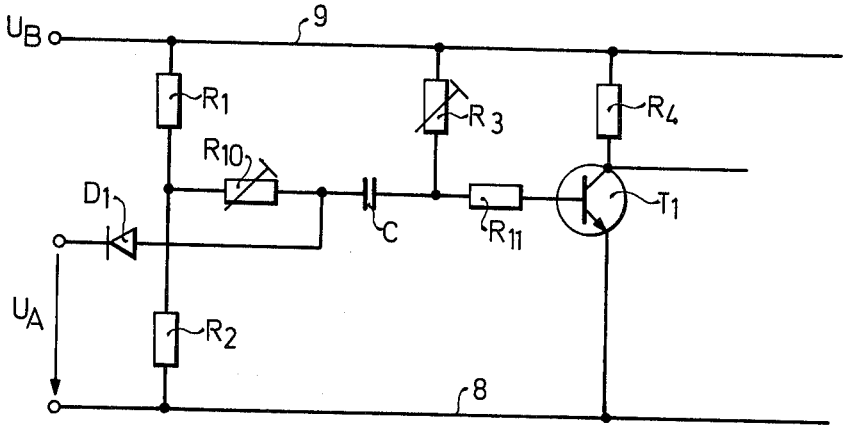
FIG. 3 is a schematic diagram of a second exemplary embodiment illustrating another manner of connecting the monostable multivibrator.

The adjustment of the rpm-dependency of this circuit for generating the $t_{p\,min}$ pulses is performed especially conveniently in the exemplary embodiment illustrated in FIG. 3, which does not require a discussion of the exact dimensions of the voltage divider ratio R1, R2. The capacitor C is coupled to the junction of the two resistors R1, R2 through an adjustable resistor R10, whose entire resistance thus affects the charging constant for the capacitor. Thus, any desired rpm-dependency may be achieved precisely because $t_{p\,min}$ may be exactly adjusted at two different rpms. The triggering via the diode D1 takes place at the junction of the resistor R10 and the capacitor C.

The foregoing represents preferred embodiments of the invention, it being understood that numerous variants thereof are possible within the spirit and scope of the invention, the latter being defined by the appended claims.

We claim:

1. A method for defining the minimum duration of fuel injection control pulses in a fuel injection system for an internal combustion engine comprising the steps of:

generating a trigger signal proportional to the rotational speed of the engine;

feeding said trigger signal to a first monostable multivibrator for generating minimum length control pulses;

feeding said trigger signal to a control multivibrator for generating preliminary fuel control pulses, in dependence on engine load and speed (rpm);

feeding said preliminary control pulses and said minimum length pulses to a logical circuit which chooses from these pulses those having the longer duration;

and feeding the output pulses from said logical circuit to a pulse width modulator circuit within the fuel injection system; whereby the delivery of fuel to said internal combustion engine is controlled by the pulses from said pulse width modulator circuit.

2. An apparatus for defining a minimum length for fuel control pulses in a fuel injection system for an internal combustion engine, comprising:

means coupled to said engine for generating trigger pulses related to engine rpm;

control multivibrator means, triggered by said trigger pulses for generating preliminary control pulses proportional to the aspirated air quantity and engine rpm;

a pulse width modulator circuit for generating fuel control signals;

monostable multivibrator means triggered by said triggering signals for generating supplementary fuel control pulses;

logical circuit means for receiving said preliminary control pulses and said supplementary control pulses, for selecting the respectively longer of said preliminary and said supplementary pulses and for generating a resultant pulse which is fed to the input of said pulse width modulator circuit.

3. An apparatus as defined by claim 2, wherein said monostable multivibrator includes a first transistor and a capacitor connected to the base of said first transistor for receiving said trigger pulses and further includes an adjustable resistor connected between a source of positive potential and the base of said first transistor, for placing said transistor in its conductive state.

4. An apparatus as defined by claim 3, wherein the emitter of said first transistor is connected to a negative source of potential and the collector of said first transistor is connected through a resistor to a positive source of potential, and wherein the base of said first transistor is connected through a resistor (R11) with a point of the circuit connected to said source of positive potential through a resistor (R3) and further including a voltage divider circuit comprising two resistors (R1, R2) the junction of which is connected to said capacitor, said junction being connected to one electrode of a diode the other electrode of which receives said triggering pulses.

5. An apparatus as defined by claim 4, wherein the impedance of said voltage divider circuit comprising said resistors (R1, R2) is such that said capacitor can be charged to the maximum degree possible within the time span of a triggering pulse; whereby the supplementary pulse train from said multivibrator circuit is independent of engine rpm.

6. An apparatus as defined by claim 4, further comprising a second transistor whose base is connected through a resistor with the collector of said first transistor, the base of said second transistor being further connected through a resistor to the source of negative potential, the base of said second resistor being further connected through a resistor to the output from said control multivibrator means, the emitter of said second transistor being connected to the source of negative potential and the collector of said second resistor being connected through a resistor to the source of positive potential.

7. An apparatus as defined by claim 6, further including a third transistor whose base is connected to the collector of said second transistor, whose emitter is connected to the source of negative potential and whose collector is connected through a resistor to the source of positive potential.

8. An apparatus as defined by claim 6, wherein the resistance of said voltage divider circuit (R1, R2) is such that said capacitor does not achieve its maximum permissible charge during a single positive triggering pulse.

9. An apparatus as defined by claim 8, wherein the junction of said voltagé divider (R1, R2) is connected through a second adjustable resistor to said capacitor.

10. An apparatus as defined by claim 8, wherein the ratio of resistors (R11, R3) connected to the base of said first transistor is such that the conductance of said first transistor is substantially independent of fluctuations of the voltage in said source of negative and positive potential.

* * * * *